United States Patent [19]

Hedberg et al.

[11] 4,145,970

[45] Mar. 27, 1979

[54] ELECTRIC DETONATOR CAP

[75] Inventors: John B. G. Hedberg, Göteborg; Nils A. L. Westerlund, Boliden, both of Sweden

[73] Assignee: Tri Electronics AB, Goteborg, Sweden

[21] Appl. No.: 782,246

[22] Filed: Mar. 28, 1977

[30] Foreign Application Priority Data

Mar. 30, 1976 [SE] Sweden ..... 7603797

[51] Int. Cl.[2] ..... F42C 11/06

[52] U.S. Cl. ..... 102/218; 102/206

[58] Field of Search ..... 102/70.2 R, 70.2 A

[56] References Cited

U.S. PATENT DOCUMENTS

| | | | |
|---|---|---|---|
| 2,818,020 | 12/1957 | Burklund | 102/28 |
| 3,225,695 | 12/1965 | Kapp et al. | 102/70.2 R |
| 3,255,366 | 6/1966 | McNulty et al. | 102/70.2 R |
| 3,277,824 | 10/1966 | Bankston | 102/28 |
| 3,288,068 | 11/1966 | Jefferson et al. | 102/70.2 A |
| 3,343,491 | 9/1967 | Peters, Jr. | 102/70.2 R |
| 3,537,399 | 11/1970 | Miller | 102/70.2 A |
| 3,640,224 | 2/1972 | Petrick et al. | 102/28 |
| 3,714,898 | 2/1973 | Ziemba | 102/70.2 R |
| 3,780,654 | 12/1973 | Shimizu et al. | 102/22 |
| 3,834,310 | 9/1974 | Ueda et al. | 102/22 |
| 3,971,317 | 7/1976 | Gemmell et al. | 102/21 |

*Primary Examiner*—Charles T. Jordan

*Attorney, Agent, or Firm*—Stevens, Davis, Miller & Mosher

[57] ABSTRACT

An electric detonator cap has a casing, which accommodates an explosive detonator charge, an electrically ignitable means for firing the detonator charge, a chargeable and dischargeable electric energy source for igniting the firing means, and an electric circuit arrangement, including a controllable switch means connected between the energy source and the firing means, an electric delay circuit, and a decoder. The energy source is connectable via connecting wires extending out from the casing, to an electric current source for charging the energy source, and the decoder is electrically connectable to said connecting wires and is adapted upon receipt of a specific electric firing command signal supplied through said connecting wires to actuate the delay circuit in a manner to close the switch means after a predetermined delay time.

6 Claims, 2 Drawing Figures

ELECTRIC DETONATOR CAP

Figure 1:
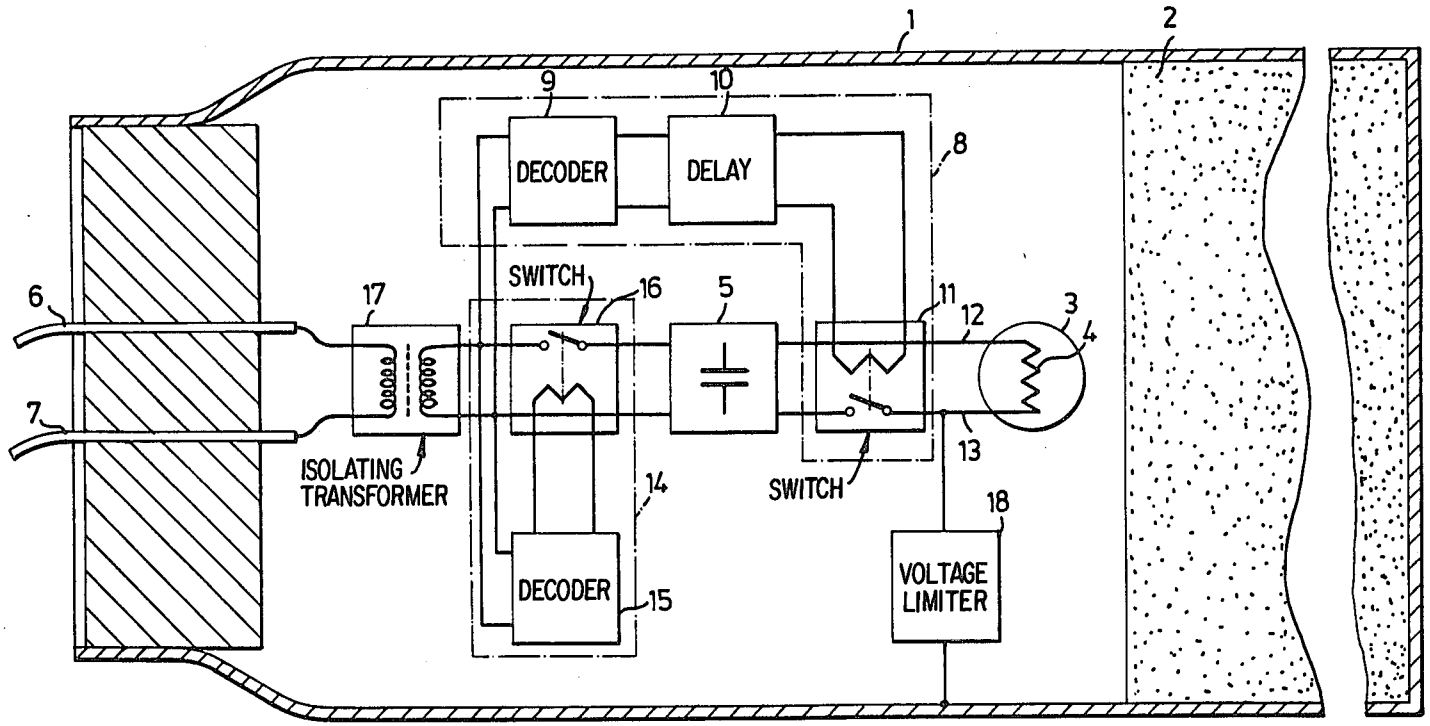

The present invention relates to an electric detonator cap of the type comprising a casing containing an explosive detonator charge, a delay device, means for firing the detonator charge and connecting wires for passing electrical energy to said firing means.

One advantage to be obtained by using electric detonator caps of the aforementioned type in blasting operations is that prior to commencing a blasting operation it is possible to check that the circuit or circuits in which a plurality of detonator caps are connected in series and/or in parallel is or are functionable and that all the caps are correctly connected up. Thus, it can readily be determined whether or not there is a break in one or the other of the circuits, and it is also possible readily to determine the presence of insulation faults. A serious disadvantage with known electric detonator caps, however, is that such caps are liable to be fired inadvertently as a result of disturbances originating from induction currents in the circuit wiring for initiating firing of the caps, radio energy, static electricity, and earth currents caused, for example, by thunder. Such inadvertent firing of the caps is particularly possible when the insulation is at fault. A further disadvantage with such known detonator caps is that the caps must be constructed so that a relatively large amount of energy is required to fire the same. As will readily be understood, if the caps are so constructed that only a small amount of electrical energy is required to fire the same, they are more readily fired by earth currents and the like. In order to increase the electrical resistance of the circuit or circuits to which the detonator caps are connected, said caps are provided with connecting wires which have a high electrical resistance, these wires consuming a considerable portion of the current supplied to fire the caps. Such wires are relatively rigid and are liable to kink when connecting the detonator caps to respective circuits. When inserting detonator caps thus connected into holes drilled into the rock, these kinks are liable to cause the wires to rub against the rock surface defining the holes, thereby damaging the insulating material encasing the wires. This is liable to result in oversparking during a firing operation, and when coming into direct contact with said rock surface may give rise to unintentional firing as a result of earth currents acting on the bare wires where the insulating material is damaged. Another disadvantage with the conventional detonator caps is that they use pyrotechnical delay devices which lack sufficient accuracy, change with time and cannot be individually checked. Pyrotechnical delay devices may also cause a detonator cap to explode during its manufacture.

An object of the present invention is to provide a novel and improved electric detonator cap of the type described in the introduction, with which the aforementioned disadvantages are at least substantially eliminated whilst the advantages obtained with known electric detonator caps retained.

To this end there is provided in accordance with the invention an electric detonator cap, comprising a casing, which accommodates an explosive detonator charge, an electrically ignitable means for firing the detonator charge, a chargeable and dischargeable electric energy source capable of storing and delivering sufficient energy for igniting the firing means, and an electric circuit arrangement, including a controllable switch means connected between the energy source and the firing means, an electric delay circuit, and a decoder, wherein the energy source via connecting wires extending out from the casing is connectable to an electric current source for charging the energy source, and wherein the decoder is electrically connectable to said connecting wires and is adapted upon receipt of a specific electric firing command signal supplied through said wires to actuate the delay circuit in a manner to close the switch means after a predetermined delay time. This arrangement affords the advantage whereby the risk of unintentional firing of the electric detonator cap as a result of earth currents is eliminated; such earth current may occur as a result, for example, of a fault in the insulation of electrically operated equipment on the blasting site, faults in the incoming power lines, and radio energy and induction currents present in the system of conductors used for initiating a firing sequence. The incorporation of a chargeable and dischargeable energy source in the electric detonator cap means that only low voltages are required to effect a firing sequence, the risk of oversparking being substantially eliminated, and these voltages may be of a form which clearly differ from such currents which may occur in the rock in which blasting is to be effected, or which may unintentionally appear on the electrical conductors of the circuit or circuits connecting together a plurality of such detonator caps. Furthermore, the conventional pyrotechnical delay device is omitted and replaced with an electric delay circuit, which provides for a much higher degree of accuracy and which can be individually tested in conjunction with manufacture.

According to further embodiments of the invention, the energy source may comprise a chargeable and dischargeable miniature accumulator or capacitor, and the detonator cap casing may accommodate a control means connected between the energy source and said connecting wires and activatable by a specific electric command signal supplied through said wires so as to connect the energy source to said connecting wires. This arrangements enable the energy source to be charged by means of a relatively small current and relatively low voltage, whereupon the risk of oversparking in the charging circuit or in the series of detonator caps is substantially eliminated. A further advantage afforded by the latter arrangement is that it is possible to check that the insulating material encasing the connecting wires is not broken and that the detonator caps are correctly connected, before energy need be stored in the detonator cap. To prevent energy from being supplied unintentionally to the electrical components of the detonator cap, these components are preferably galvanically separated from said connecting wires. This separation may be effected, for example, by means of an isolating transformer.

Conveniently, means are provided for preventing the occurrence of substantial voltage differences between the firing means, which may have the form of a fuse head, and the casing of the electric detonator cap, which differences may cause oversparking between the casing and the firing means, thereby to cause unintentional firing of the detonator cap, such means may comprise one or more zener diodes connected between the casing and the firing means and which become conductive at a predetermined voltage difference between the firing means and the casing.

Figure 2:
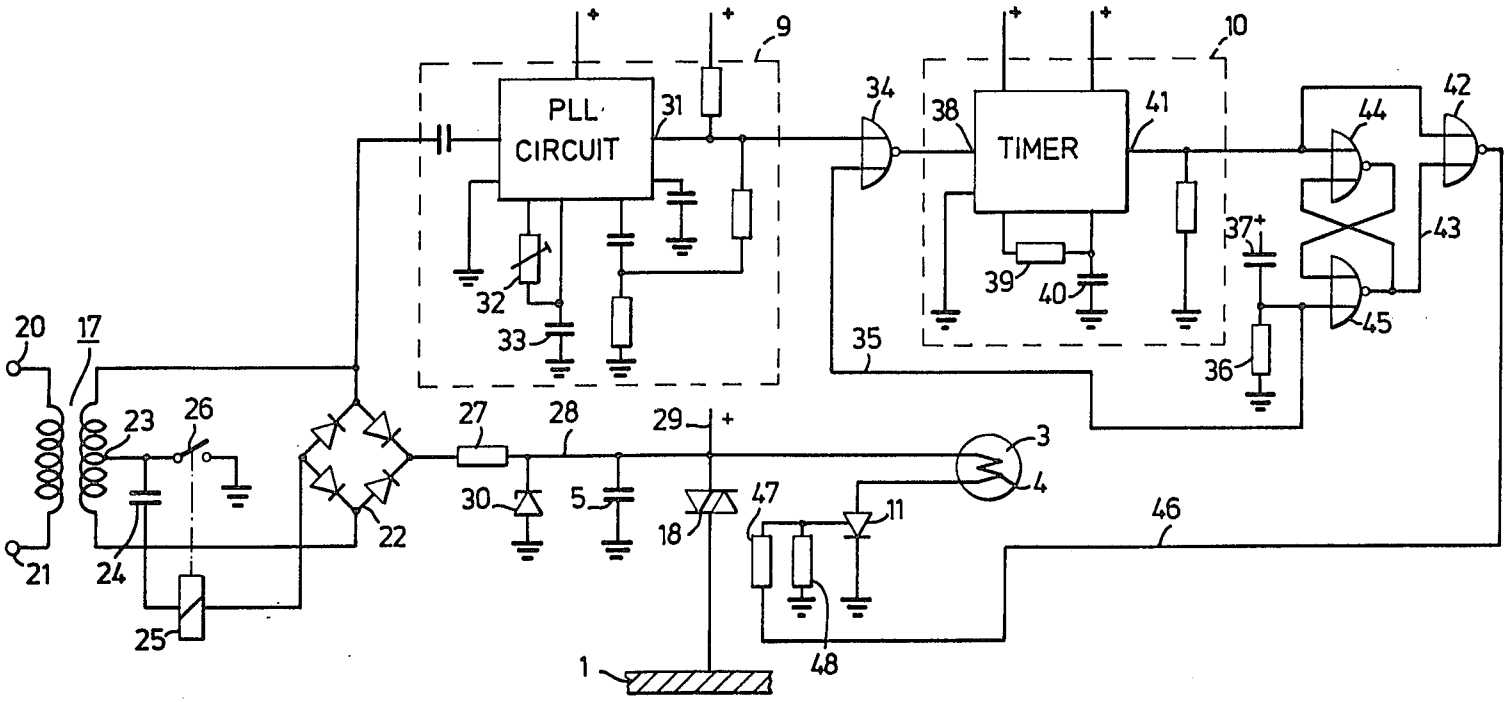

So that the invention will be more readily understood and optional features thereof made apparent, an exemplary embodiment of the invention will now be described with reference to the accompanying diagrammatic drawings, in which:

FIG. 1 is an axial sectional view of an electric detonator cap according to the invention; and FIG. 2 is a more detailed circuit arrangement, which can be used with the detonator cap of FIG. 1.

In the drawings, corresponding elements in the different Figures have been identified with the same reference numerals.

The detonator cap illustrated in FIG. 1 comprises a casing 1 which includes an explosive charge 2, which is only partially illustrated, and a firing means 3, which in the illustrated embodiment comprises a fuse head, the electric filament of the fuse head being identified at 4.

Incorporated in the electric detonator cap is a chargeable and dischargeable energy source 5 which is capable of storing sufficient energy to effect a firing sequence and which, in the illustrated embodiment, comprises a capacitor which can be charged via connecting wires 6 and 7 of the detonator cap. To prevent unintentional discharge of the energy source 5, when said source is charged, there is provided a control means, generally identified at 8, which is activated, via the connecting wires 6, 7, when a specific electric firing command signal is applied to said wires. The firing command signal is selected so that there is no similarity between it and electrical signals obtained from currents, such as earth currents, induction currents, or from currents originating from other current sources present in the area of the blasing site, and from radio energy. The control means 8 comprises a decoder 9 which influences, via an electric delay circuit 10, such as an RC-circuit, a switch means 11 which is effective to connect the source of energy 5 to the connecting wires 12, 13 of the filament 4. In order to increase the reliability of the arrangement against unintentional firing, the energy source 5 is not charged until firing is about to commence. To this end there is provided a further control means 14 which can be activated by means of a specific, second electric command signal on the wires 6, 7, this signal differing from the firing command signal which activates the decoder 9 and the aforementioned currents from other current sources present on the blasing site, and from earth currents, induction currents and radio energy. The further control means 14 comprise a decoding circuit 15 arranged to activate a switch means 16 to connect the energy source 5 to the connecting wires 6, 7. In order to protect the electrical components of the detonator cap against over-voltages in the wires 6, 7 and to prevent unintentional ignition of the firing means 3, the electrical components of the detonator cap arrangement are D.C. isolated from the connectng wires 6, 7. To this end, there is provided in the illustrated embodiment an isolating transformer 17 which is connected between the wires 6, 7 and the control means 8 and 14.

In order to further safeguard against the ignition of the firing means 3 as a result of a voltage difference between said means and the casing 1, there is connected between the supply line 13 and the casing 1 a voltage limiting circuit 18, which may comprise a zener diode or varistor and which is made conductive at a predetermined voltage difference between the means 3 and the casing 1.

In FIG. 2 the terminals 20, 21 of the primary winding of the transformer 17 are assumed to be connected to the connecting wires 6 and 7 (shown in FIG. 1). The terminals of the secondary winding of the transformer 17 are connected to a rectifier bridge 22. Furthermore, the secondary side of the transformer 17 is provided with a centre tap 23, which is connected in the manner shown to the rectifier bridge 22 via a capacitor 24 and the winding 25 of a relay, and which is connectable to earth via the contact 26 of said relay. When alternating current of a frequency such that the inductance of the transformer 17 and the capacitor 24 are in resonance, a current passes through the relay winding 25 to close the relay contact 26. Thus, the inductance of the transformer 17, the relay and the capacitor 24 correspond to the control means 14 of FIG. 1.

The voltage necessary to operate the electronic components of the circuit arrangement is applied from the rectifier bridge 22 via resistor 27 and lines 28, 29, said voltage being stabilized by the zener diode 30. The rectifier bridge also supplies via resistor 27 and line 28 sufficient electric energy for charging the energy source 5, whch comprises a capacitor connected between line 28 and earth. One of the terminals of the firing means 3 is connected to line 28 and the other terminal is connected to earth via the switch means 11 which comprises a thyristor controlled by the decoder 9 and the delay circuit 10.

The decoder 9 comprises a phase-locked loop (PLL) circuit which in the shown example is of the type sold by Signetics International Corp., London, England, under the designation NE 567 and is connected in the manner recommended by the manufacturer. The frequency at which the PLL circuit 9 changes its state and delivers a "zero"-signal on the output terminal 31 thereof is determined by the selected dimensions of the resistor 32 and the capacitor 33. When the frequency of the voltage applied by the transformer 17 coincides with the frequency set by resistor 32 and capacitor 33, the output terminal 31 of the PLL circuit is set to "zero". The output terminal 31 is connected to a NOR gate 34. To prevent setting of the output of the NOR gate 34 to "one" immediately upon applying a voltage to the circuit arrangement, the output signal from the PLL circuit 9 is applied to the NOR gate 34 together with a signal supplied via line 35 from a RC circuit comprising a resistor 36 and a capacitor 37.

The capacitor 5 is dimensioned and charged so as to be able to deliver sufficient energy for firing the fuse head 3 and for operating the electronic components up to the firing moment. When the capacitor 5 is charged to sufficient level, a firing command signal of a specific frequency is supplied through the connecting wires 6, 7 and the firing command signal is decoded in the PLL circuit 9. When the correct firing command signal is received by the PLL circuit, the output 31 of the PLL circuit 9 is set to "zero" and the output of the NOR gate 34 is set to "one". The output signal from the NOR gate 34 is applied to the trigger input 38 of the delay circuit 10 which in the embodiment of FIG. 2 is a precision timer circuit of the type sold by National Semiconductor Corp., USA, under the designation LM 2905 and is connected in the manner recommended by the manufacturer. The delay time of the timer circuit 10 is determined by resistor 39 and capacitor 40. The signal on the output terminal 41 of the timer circuit 10 is set to "one" when a signal is received on input terminal 38. Upon termination of the delay time, the signal on the terminal 41 is again set to "zero". This output signal is inverted in NOR gate 42. To prevent setting of the output of the NOR gate 42 to "one" immediately upon applying a voltage to the circuit arrangement, the output signal from the timer circuit 10 is applied to the NOR gate 42 together with a signal supplied via line 43 from a flip-flop comprising NOR gates 44 and 45. The firing command, i.e., the output signal of the NOR gate 42 is fed via line 46 and current limiting resistor 47 to the gate of the thyristor 11. The thyristor 11 is then made conductive and discharges the capacitor 5 through the filament 4 of the fuse head 3.

Resistor 48 is dimensioned to prevent unintentional ignition of the thyristor 11, and the two zener diodes connected in antiparallel between the line 28 and the casing 1 prevent excessive voltage difference between the filament 4 and the casing 1.

The invention is not restricted to the aforedescribed and illustrated embodiment, but can be varied within the scope of the following claims. For example, although, for the sake of illustration, the electronic components of the detonating cap arrangement have been shown to be separate from each other, it lies within the scope of the invention to incorporate these components into one or a few integrated circuits.

We claim:

1. An electric detonator cap comprising:

a casing accommodating an explosive detonator charge;

an electrically ignitable means for firing said detonator charge;

a chargeable and dischargeable electric energy source for storing and providing sufficient energy for igniting said firing means; and, an electric circuit for controlling the application of electrical energy to said firing means, said electric circuit comprising:

a controllable switch connected between said energy source and said firing means, a pair of connecting wires for receiving an applied electrical energy and control signals, means for providing electrical energy applied to said connecting wires to said energy source, a decoder providing an output signal in response to the presence of a control signal having a predetermined electrical characteristic on said connecting wires, and a delay circuit responsive to said decoder output signal for providing a switch control output signal a predetermined period of time after said decoder output signal appears, said switch means being responsive to said switch control output signal to supply voltage from said energy source to said firing means.

2. An electric detonator cap according to claim 1, wherein the energy source comprises a chargeable and dischargeable capacitor.

3. An electric detonator cap according to claim 2, where said means for providing includes a control means connected between said energy source and said connecting wires which is activatable by a specific electric command signal supplied through said connecting wires so as to connect said energy source to said connecting wires.

4. An electric detonator cap according to claim 1, wherein the electrical components of the detonator cap are D.C. isolated from said connecting wires.

5. An electric detonator cap according to claim 1, wherein a means is provided for preventing substantial differences in voltage from occurring between said firing means and said casing.

6. A detonator cap as in claim 1 wherein said means for firing, energy source, and electric circuit are all housed in said casing which has said pair of connecting wires projecting therefrom.

* * * * *